US009490591B2

(12) United States Patent
Yamashita et al.

(10) Patent No.: US 9,490,591 B2
(45) Date of Patent: Nov. 8, 2016

(54) CONNECTOR MATEABLE WITH MATING CONNECTOR AND HAVING FIRST AND SECOND MEMBERS WHICH ARE ELECTRICALLY SEPARATED

(71) Applicant: JAPAN AVIATION ELECTRONICS INDUSTRY, LIMITED, Shibuya-ku, Tokyo (JP)

(72) Inventors: Masaki Yamashita, Tokyo (JP); Kazuaki Ibaraki, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/727,464

(22) Filed: Jun. 1, 2015

(65) Prior Publication Data

US 2016/0028198 A1 Jan. 28, 2016

(30) Foreign Application Priority Data

Jul. 25, 2014 (JP) ..... 2014-152134

(51) Int. Cl.
*H01R 9/05* (2006.01)
*H01R 24/40* (2011.01)

(52) U.S. Cl.
CPC ..... *H01R 24/40* (2013.01)

(58) Field of Classification Search
CPC ..... H01R 24/38; H01R 9/05; H01R 9/0506; H01R 13/6592
USPC ..... 439/578, 579, 607.41, 607.42
See application file for complete search history.

(56) References Cited

U.S. PATENT DOCUMENTS 6,860,760 B2 * 3/2005 Endo ..... H01R 24/40 439/578
8,079,870 B2 * 12/2011 Nakamura ..... H01R 9/0518 439/585
8,998,641 B2 * 4/2015 Kanda ..... H01R 13/6592 439/585
9,059,521 B2 * 6/2015 Chen ..... H01R 9/0503
2005/0118866 A1 * 6/2005 Abe ..... H01R 13/04 439/578
2014/0094061 A1 4/2014 Chen et al.

FOREIGN PATENT DOCUMENTS

JP 2013168339 A 8/2013
JP 2014072188 A 4/2014

* cited by examiner

*Primary Examiner* — Hae Moon Hyeon
(74) *Attorney, Agent, or Firm* — Holtz, Holtz & Volek PC

(57) ABSTRACT

A connector is attached to a cable which has a center conductor and a shield. The connector is mateable with a mating connector along a front-rear direction. The mating connector includes a mating contact and a mating shell, which has a mating lock portion and a shell contact portion. The connector includes first and second members. The second member has a front portion and a rear portion. The front portion is provided with a lock portion. One of the rear portion and the front portion is provided with a second contact portion. Under a state where the connector and the mating connector are connected with each other, the lock portion locks the mating lock portion while the second contact portion is brought into contact with the shell contact portion, so that the first member and the second member are maintained in a state in which they are electrically separated.

17 Claims, 15 Drawing Sheets

CONNECTOR MATEABLE WITH MATING CONNECTOR AND HAVING FIRST AND SECOND MEMBERS WHICH ARE ELECTRICALLY SEPARATED

CROSS REFERENCE TO RELATED APPLICATIONS

An applicant claims priority under 35 U.S.C. §119 of Japanese Patent Application No. JP2014-152134 filed Jul. 25, 2014.

BACKGROUND OF THE INVENTION

This invention relates to a connector which is connected to a micro coaxial cable or a coaxial cable, and to a connector assembly comprising the connector.

JP-A 2014-72188 (Patent Document 1) describes a prior art connector assembly. As shown in FIG. 29, the prior art connector assembly of Patent Document 1 comprises a connector 900 and a mating connector 910. The connector 900 is attached to a cable 930. The connector 900 and the mating connector 910 are mated with each other in a mating direction, or a Z-direction. The cable 930 extends in an extending direction, or an X-direction. Since the mating direction is perpendicular to the extending direction, the connector 900 is likely to be disconnected from the mating connector 910 if both the connector 900 and the mating connector 910 are miniaturized. In contrast, as shown in FIG. 30, Patent Document 1 discloses a connector assembly which comprises a connector 950 and a mating connector 960. The connector has a mating portion 955. The connector 950 is attached to a cable 970. The connector 950 and the mating connector 960 are mated with each other in a mating direction, or an X-direction. The cable 970 extends in an extending direction, or the X-direction. Specifically, the mating direction is same as the extending direction. Accordingly, the mating portion 955 can have a sufficient size while the connector 950 can be hardly disconnected from the mating connector 960.

SUMMARY OF THE INVENTION

It is an object of the present invention to provide a connector which is connected to a cable such as a micro coaxial cable or a coaxial cable and which can be further miniaturized. In addition, it is another object of the present invention to provide a connector assembly which includes the above-mentioned connector.

One aspect of the present invention provides a connector attached to a cable which has a center conductor and a shield. The connector is mateable with a mating connector along a front-rear direction. The mating connector comprises a mating contact and a mating shell. The mating shell is provided with a mating lock portion and a shell contact portion. The connector comprises a first member and a second member which is formed separately from the first member. The first member is positioned frontward of the second member in the front-rear direction. The first member has a first connection portion and a first contact portion. The first connection portion is connected to the center conductor. When the connector and the mating connector are connected with each other, the first contact portion is brought into contact with the mating contact. The second member has a front portion and a rear portion which is positioned rearward of the front portion in the front-rear direction. The rear portion is provided with a second connection portion which is connected to the shield. The front portion is provided with a lock portion. One of the rear portion and the front portion is provided with a second contact portion. Under a state where the connector and the mating connector are connected with each other, the lock portion locks the mating lock portion while the second contact portion is brought into contact with the shell contact portion, so that the first member and the second member are maintained in a state where the first member and the second member are electrically separated from each other.

Another aspect of the present invention provides a connector assembly comprising the connector and a mating connector. The first member is positioned apart from the second member in the front-rear direction. The cable comprises an insulator which insulates the center conductor and the shield from each other. The mating shell has a spring portion. The mating lock portion and the shell contact portion are provided at the spring portion. Under a state where the connector and the mating connector are connected with each other, the spring portion presses the shell contact portion against the second contact portion so that the second contact portion is sandwiched between the shell contact portion and the insulator.

The connector of the present invention comprises the first member and the second member which are arranged and separated from each other in the front-rear direction. Furthermore, when the connector and the mating connector are connected with each other, the lock portion of the second member locks the mating lock portion of the mating shell while the second contact portion of the second member is brought into contact with the shell contact portion of the mating shell, so that the first member and the second member are maintained in a state where the first member and the second member are electrically separated from each other. Accordingly, a housing of the connector can be omitted so that an overall size of the connector can be reduced.

An appreciation of the objectives of the present invention and a more complete understanding of its structure may be had by studying the following description of the preferred embodiment and by referring to the accompanying drawings.

Figure 1:
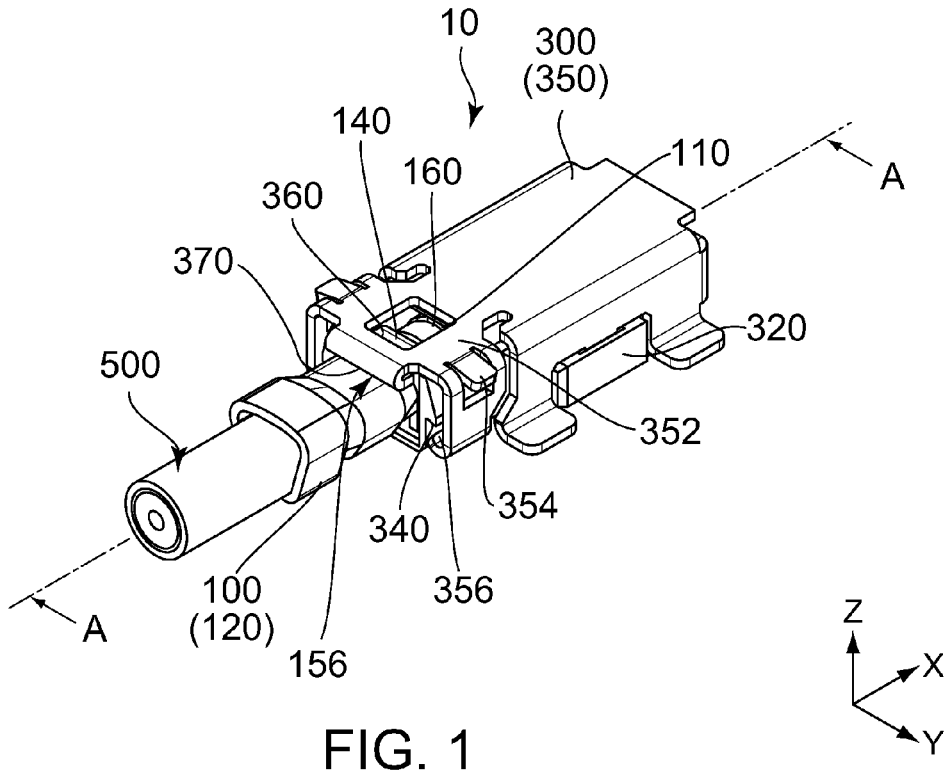
FIG. 1 is a perspective view showing a connector assembly which comprise a connector and a mating connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
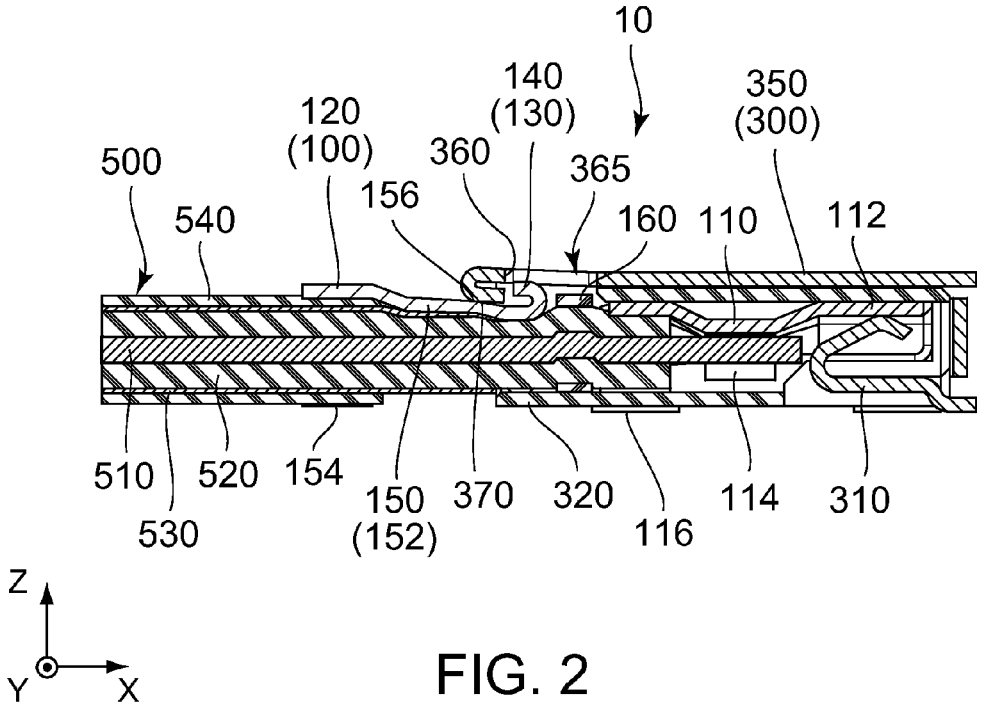
FIG. 2 is a cross-sectional view showing the connector assembly of FIG. 1, taken along line A-A.

With reference to FIGS. 1 and 2, a connector assembly 10 according to a first embodiment of the present invention comprises a connector 100 and a mating connector 300. The connector 100 is attached to a cable 500. The mating connector 300 is to be fixed on an object (not shown) such as a circuit board. The cable 500 which is attached to the connector 100 extends along an extending direction, or a front-rear direction. The connector 100 is connected with the mating connector 300 along a connection direction, or the front-rear direction. The front-rear direction is an X-direction. Specifically, in the present embodiment, the connection direction of the connector 100 and the mating connector 300 is same as the extending direction of the cable 500 which is attached to the connector 100.

As shown in FIG. 2, the cable 500 of the present embodiment is a micro coaxial cable. The cable 500 comprises a center conductor 510, an insulator 520, a shield 530 and an outer cover (jacket) 540. The insulator 520 covers the center conductor 510. The shield 530 is provided on the insulator 520. The outer cover 540 covers the shield 530. Specifically, the insulator 520 insulates the center conductor 510 and the shield 530 from each other.

As shown in FIGS. 3 to 6, the connector 100 comprises a first member 110, a second member 120 and an insulator member 160. The first member 110 is made of conductor. The second member 120 is made of conductor. However, each of the first member 110 and the second member 120 may be made of material other than conductor. For example, each of the first member 110 and the second member 120 may be formed of non-conductive material plated with conductor.

The connector 100 according to the present embodiment does not comprise a housing which holds the first member 110. Accordingly, as described below, the first member 110 and the second member 120 are separated from each other and are independently attached to the cable 500.

As understood from FIGS. 3 to 6, the first member 110 is distinct and separated from the second member 120. The first member 110 is positioned frontward, or toward a positive X-side, of the second member 120 in the front-rear direction. Accordingly, the first member 110 forms an end, or a positive X-side end, of the connector 100.

Figure 4:
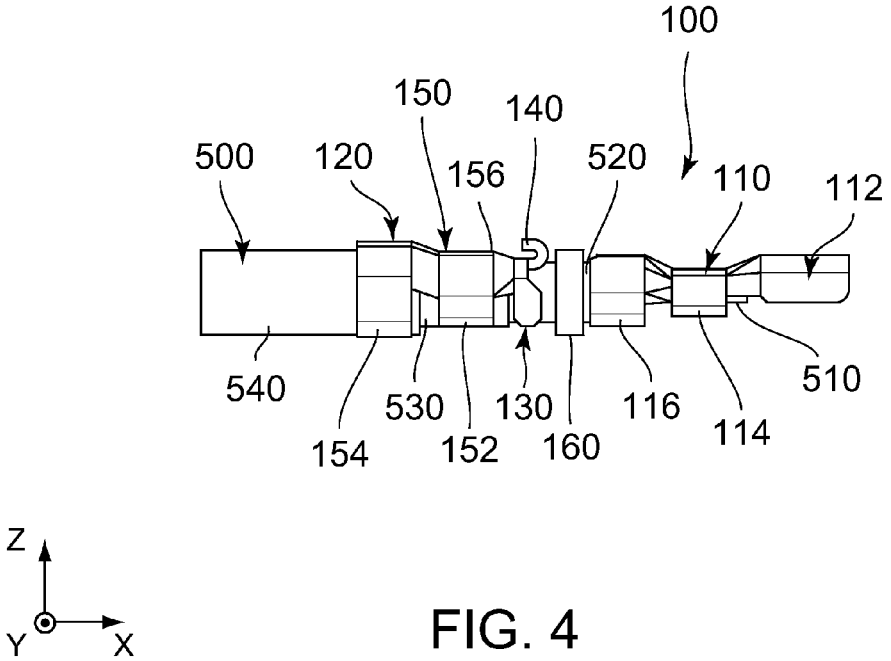
FIG. 4 is a side view showing the connector of FIG. 3.
Figure 5:
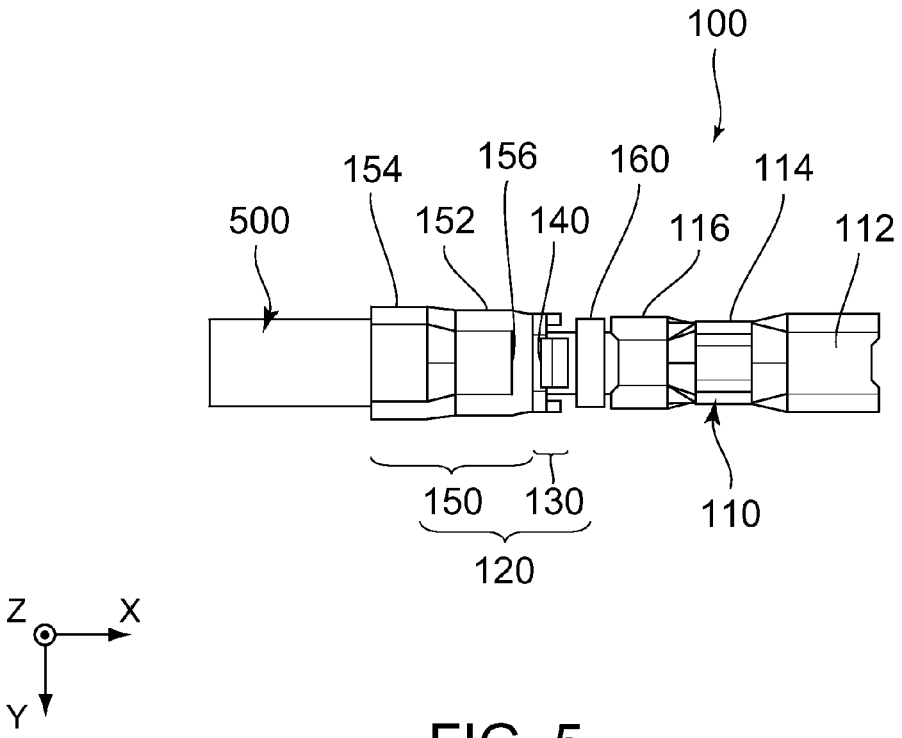
FIG. 5 is a top view showing the connector of FIG. 3.

In particular, as shown in FIGS. 4 and 5, the first member 110 is positioned apart from the second member 120 in the front-rear direction. Accordingly, when the connector 100 is connected to the mating connector 300 (see FIG. 1) so that each of the first member 110 and the second member 120 is appropriately fixed to the mating connector 300, the first member 110 and the second member 120 are never short-circuited with each other.

Figure 6:
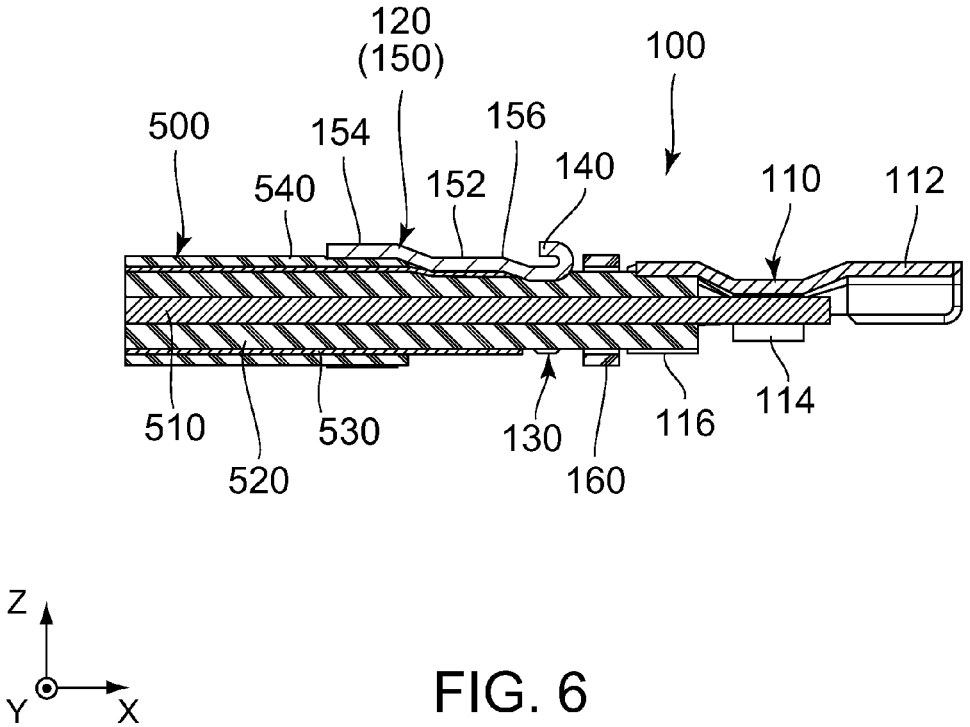
FIG. 6 is a cross-sectional view showing the connector of FIG. 3, taken along line B-B.
Figure 7:
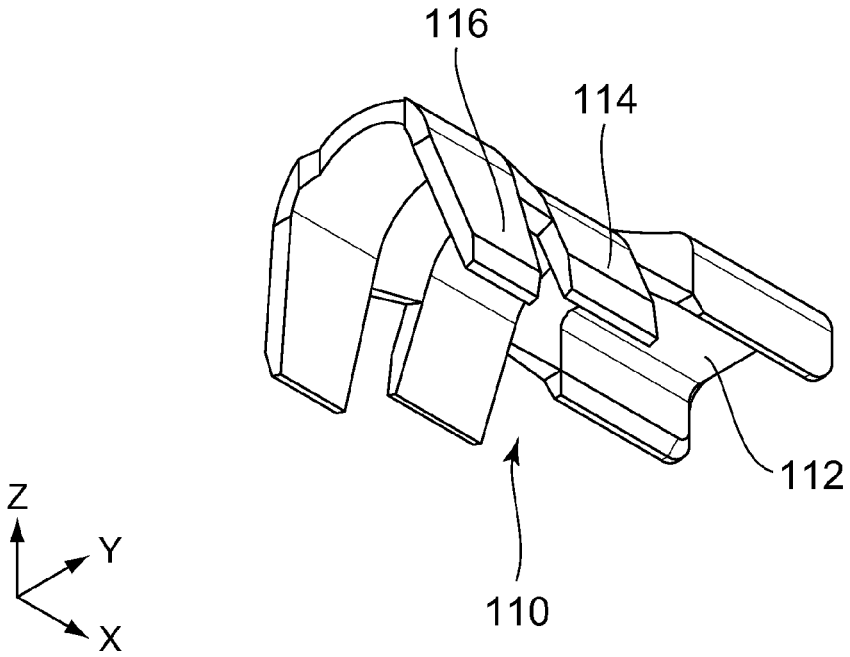
FIG. 7 is a perspective view showing a first member which is included in the connector of FIG. 3. The illustrated first member is in a state where the first member is not yet attached to the cable.

As shown in FIG. 6, the first member 110 has a first contact portion 112, a first connection portion 114 and an insulator holding portion 116. The first connection portion 114 is connected to the center conductor 510. The insulator holding portion 116 holds the insulator 520. As shown in FIG. 2, the first contact portion 112 is brought into contact with a mating contact 310 when the connector 100 and the mating connector 300 are connected with each other. Detail description about the mating contact 310 is described later. As shown in FIG. 7, each of the first connection portion 114 and the insulator holding portion 116 according to the present embodiment has two pieces which roughly face each other in a lateral direction, or a Y-direction. Each of the first connection portion 114 and the insulator holding portion 116 according to the present embodiment is crimped on the cable 500 to be attached thereto. In detail, the first connection portion 114 is crimped on the center conductor 510 to be connected thereto, and the insulator holding portion 116 is crimped on the insulator 520 to hold it.

As shown in FIG. 6, the second member 120 has a front portion 130 and a rear portion 150. The rear portion 150 is positioned rearward of the front portion 130 in the front-rear direction.

As shown in FIG. 6, the rear portion 150 has a second connection portion 152 and an outer cover holding portion 154. The second connection portion 152 is connected to the shield 530. The outer cover holding portion 154 holds the outer cover 540. As understood from FIG. 8, each of the second connection portion 152 and the outer cover holding portion 154 according to the present embodiment has two pieces which roughly face each other in the lateral direction, or the Y-direction. Each of the second connection portion 152 and the outer cover holding portion 154 according to the present embodiment is crimped on the cable 500 to be attached thereto. In detail, the second connection portion 152 is crimped on the shield 530 to be connected thereto, and the outer cover holding portion 154 is crimped on the outer cover 540 to hold it.

As described later, a part of the rear portion 150 of the present embodiment functions as a second contact portion 156 which is brought into contact with a part of the mating connector 300. However, the present invention is not limited thereto. For example, the second contact portion 156 may be provided on the front portion 130.

Figure 8:
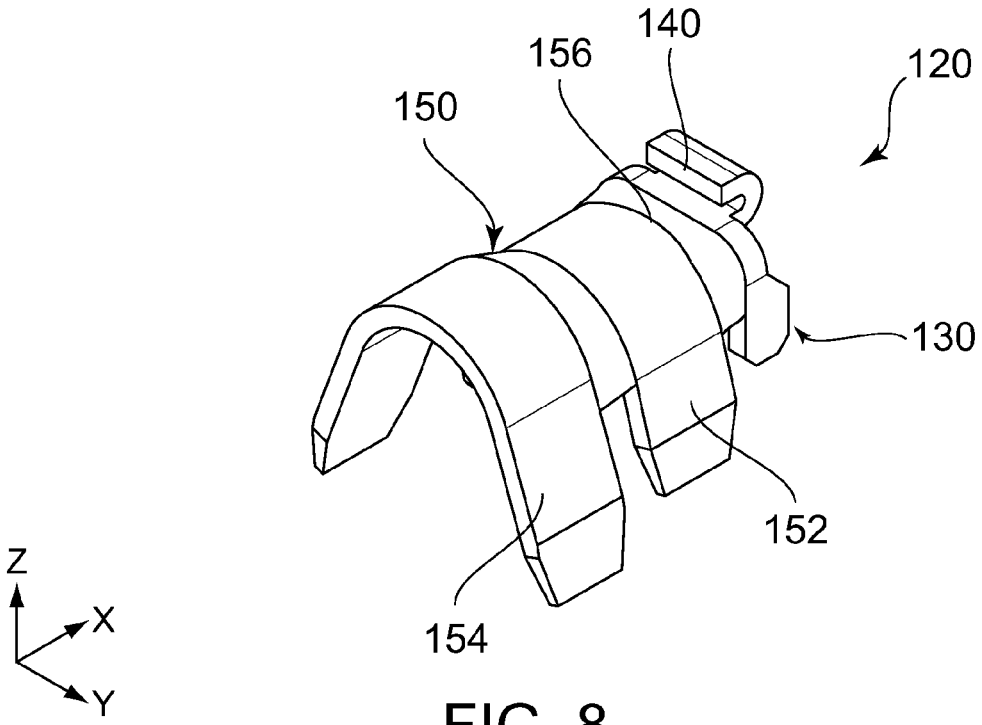
FIG. 8 is a perspective view showing a second member which is included in the connector of FIG. 3. The illustrated second member is in a state where the second member is not yet attached to the cable.

As shown in FIG. 8, the front portion 130 is provided with a lock portion 140. As described later, under a connection state where the connector 100 and the mating connector 300 are connected with each other, the lock portion 140 locks a part of the mating connector 300 to maintain the connection state. The lock portion 140 is positioned frontward of the second contact portion 156 in the front-rear direction. In the present embodiment, the lock portion 140 forms an end, or a positive X-side end, of the second member 120. In addition, a whole of the front portion 130 of the present embodiment is positioned frontward of the second connection portion 152 in the front-rear direction. Accordingly, when the second connection portion 152 is crimped on the shield 530, the front portion 130 provides no obstacle to the crimping operation of the second connection portion 152. Similarly, when the outer cover holding portion 154 is crimped on the outer cover 540, the front portion 130 provides no obstacle to the crimping operation of the outer cover holding portion 154.

As shown in FIGS. 4 and 6, the lock portion 140 of the present embodiment is positioned slightly above, or toward a positive Z-side of, the outer cover holding portion 154. A height, or a size in the Z-direction, of the connector 100 is mainly determined by an external diameter of the outer cover 540 of the cable 500. In order to minimize the height of the connector 100, it is preferable that an upper end of the outer cover holding portion 154 is positioned at an uppermost part of the second member 120 in an up-down direction, or in the Z-direction, while a whole of the front portion 130 is positioned below, or toward a negative Z-side of, the outer cover holding portion 154 in the up-down direction.

Figure 3:
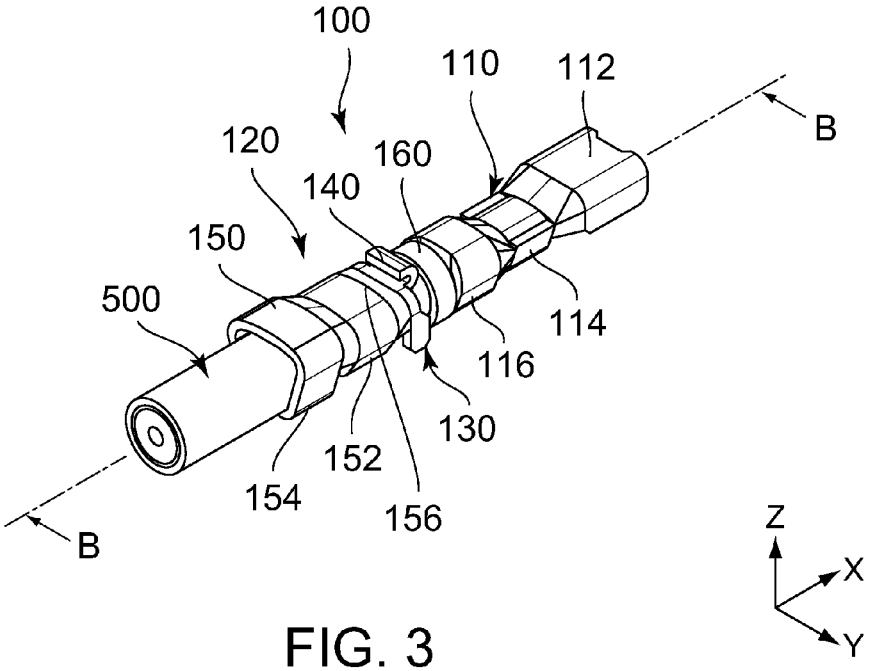
FIG. 3 is a perspective view showing the connector which is included in the connector assembly of FIG. 1.

As understood from FIGS. 3 to 5, the second member 120 of the present embodiment has only the front portion 130 and the rear portion 150. The second member 120 of the present embodiment does not have, for example, a function similar to that of a shell which surrounds the first member 110 in a plane, or a YZ-plane, perpendicular to the front-rear direction. In addition, as understood from FIG. 5, the first member 110 does not overlap the second member 120 so that the first member 110 is visible when the first member 110 is seen along the up-down direction under a state where the first member 110 and the second member 120 are attached to the cable 500.

As shown in FIGS. 3 to 6, the insulator member 160 is positioned between the first member 110 and the second member 120 in the front-rear direction while being positioned so as to surround the insulator 520 of the cable 500. The insulator member 160 of the present embodiment is formed by separating a part of the outer cover 540. Specifically, the insulator member 160 of the present embodiment is formed by using the part of the outer cover 540 which is to be discarded. Accordingly, material cost of the connector 100 never increases even if the connector 100 is provided with the insulator member 160. In the present embodiment, the first member 110 and the second member 120 are arranged not to be short-circuited with each other without being provided with the insulator member 160. In a case where the connector 100 is provided with the insulator member 160, the first member 110 and the second member 120 can be more securely prevented from being short-circuited with each other. The insulator member 160 may be formed by using a member other than the part of the outer cover 540 which is separated therefrom. In that case, in order to securely prevent the first member 110 and the second member 120 from being short-circuited with each other, it is preferable, for example, that the insulator member 160 is arranged not to be moved frontward beyond a rear end, or a negative X-side end, of the first member 110. Specifically, it is preferable that a first area is smaller than a second area, wherein the insulator member 160 has an inner periphery, the first area is defined by the inner periphery in a plane perpendicular to the front-rear direction, the first member 110 has the rear end attached to the cable 500, and the second area is a total area of a cross-section of the rear end and a cross-section of the cable 500 in a plane perpendicular to the front-rear direction.

Figure 9:
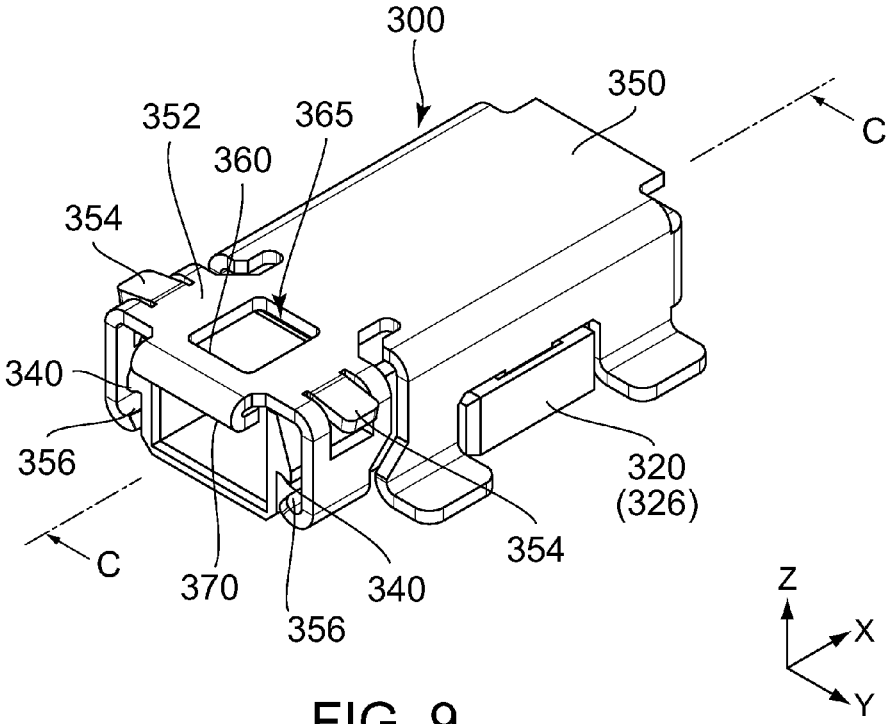
FIG. 9 is a perspective view showing the mating connector which is included in the connector assembly of FIG. 1.
Figure 10:
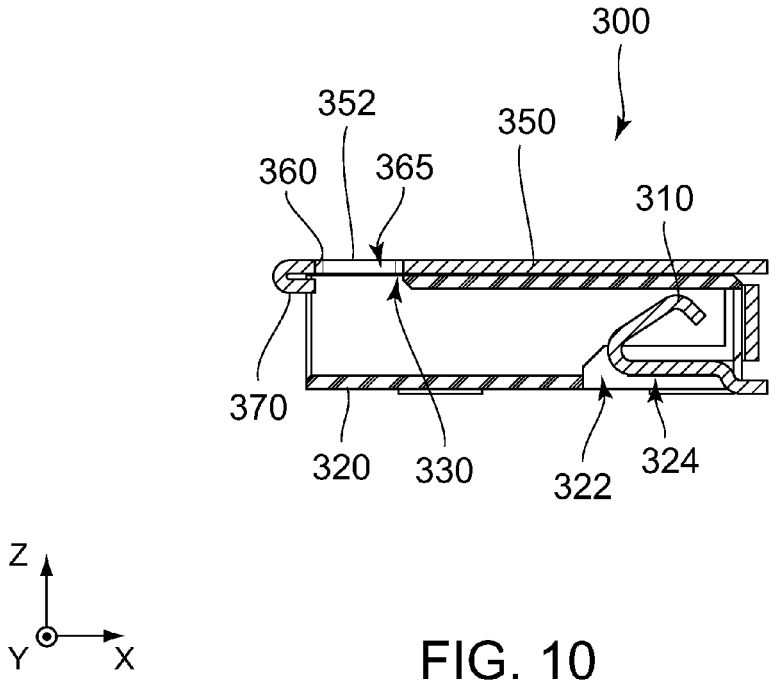
FIG. 10 is a cross-sectional view showing the mating connector of FIG. 9, taken along line C-C.
Figure 11:
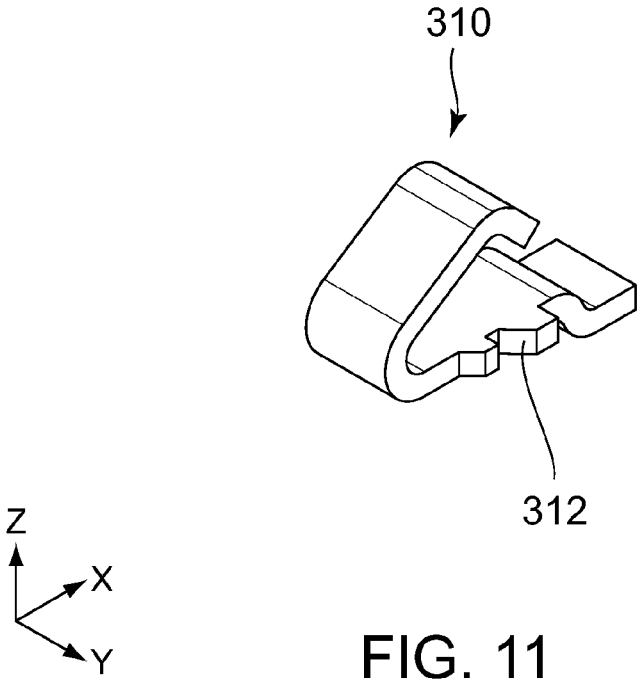
FIG. 11 is a perspective view showing a mating contact which is included in the mating connector of FIG. 10.

As understood from FIGS. 9 and 10, the mating connector 300 comprises a mating contact 310, a mating housing 320 and a mating shell 350. The mating contact 310 is made of conductor. The mating housing 320 is made of insulator. The mating shell 350 is made of metal. As shown in FIG. 11, the mating contact 310 is provided with a press-fit portion 312. The mating contact 310 is connected to the first member 110 under the connection state where the connector 100 (see FIG. 1) and the mating connector 300 are connected with each other. Although the mating contact 310 of the present embodiment is made of conductor, the mating contact 310 may be formed of non-conductive material plated with conductor similar to the first member 110 and the second member 120. The mating shell 350 may be made of material other than metal, provided that the mating shell 350 made of the material electromagnetically shields the mating contact 310 and the first member 110 under a connection state where the mating contact 310 and the first member 110 are connected with each other.

Figure 12:
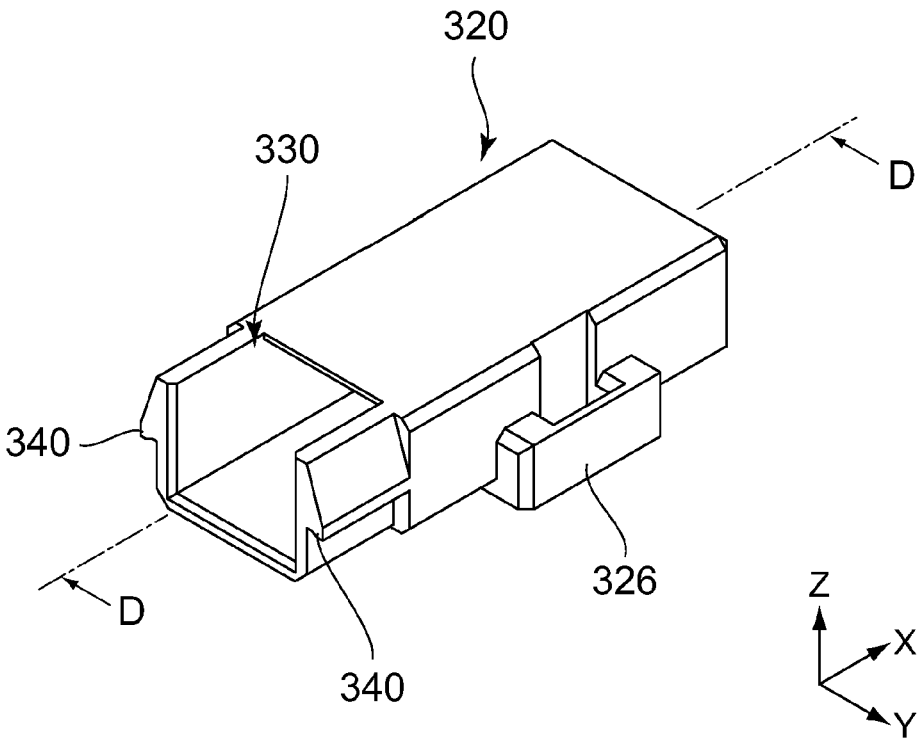
FIG. 12 is a perspective view showing a mating housing which is included in the mating connector of FIG. 10.
Figure 13:
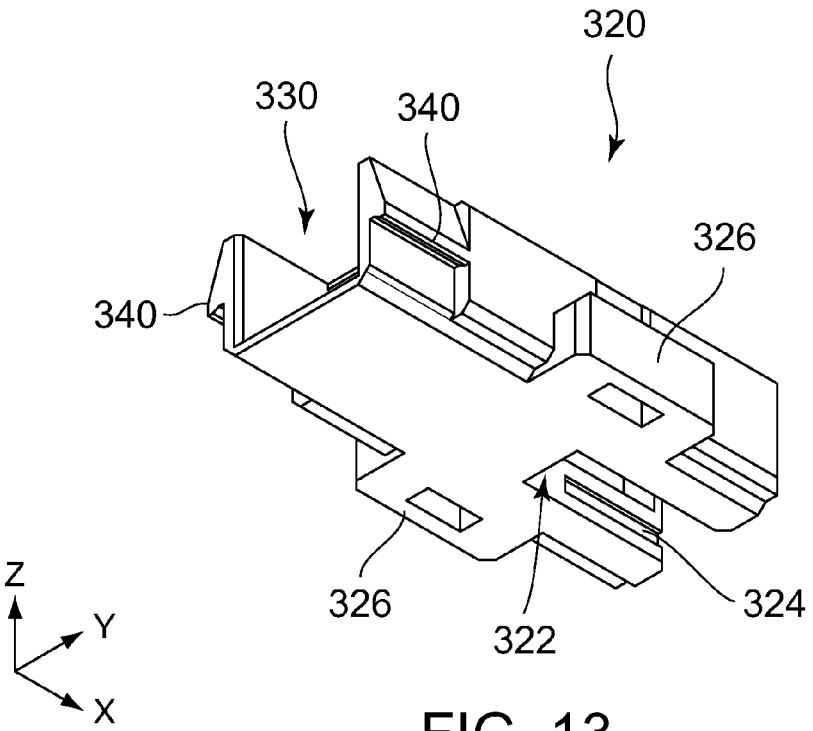
FIG. 13 is another perspective view showing the mating housing of FIG. 12.
Figure 14:
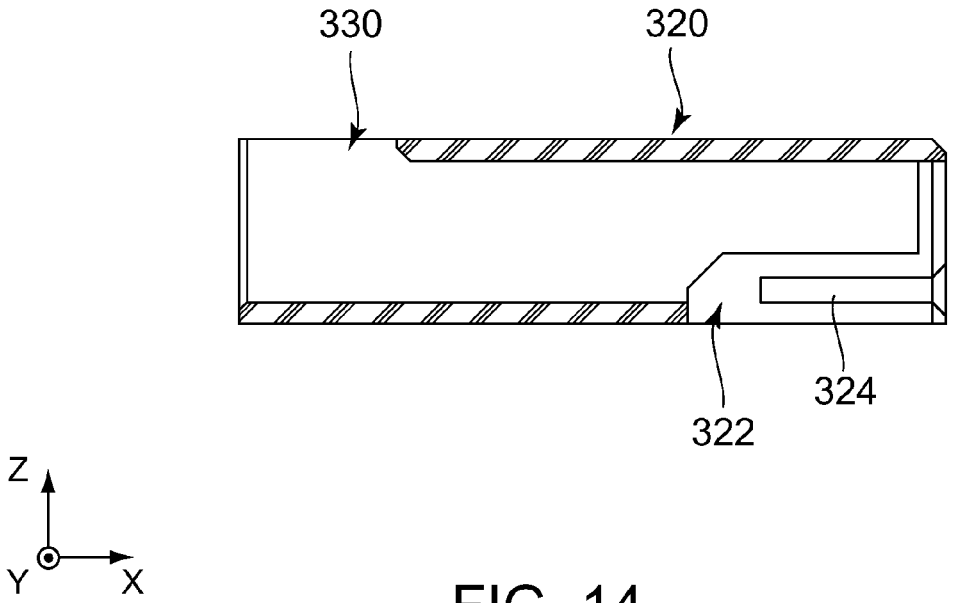
FIG. 14 is a cross-sectional view showing the mating housing of FIG. 12, taken along line D-D.

As shown in FIGS. 12 to 14, the mating housing 320 has a substantially rectangular tube-like shape. As shown in FIGS. 13 and 14, the mating housing 320 is provided with a lower recess 322. The lower recess 322 has two inner walls which face each other in the lateral direction. When the press-fit portion 312 (see FIG. 11) of the mating contact 310 is press-fitted into the lower recess 322, the two inner walls function as contact holding portions 324, respectively, which hold the mating contact 310. As shown in FIG. 13, the mating housing 320 is further formed with two shell holding portions 326, an upper recess 330 and two first regulating portions 340. Each of the shell holding portions 326 projects outward in the lateral direction. As described later, the shell holding portions 326 hold parts of the mating shell 350, respectively. The upper recess 330 is formed at a side of the mating housing 320 which is opposite, in both the up-down direction and the front-rear direction, to another side thereof where the lower recess 322 is positioned. The first regulating portions 340 are formed at opposite ends, respectively, of the mating housing 320 in the lateral direction. Each of the first regulating portions 340 is located at a position almost same as that of the upper recess 330 in the front-rear direction. Each of the first regulating portions 340 has a barb-like shape in the plane, or the YZ-plane, perpendicular to the front-rear direction and extends in the front-rear direction.

Figure 15:
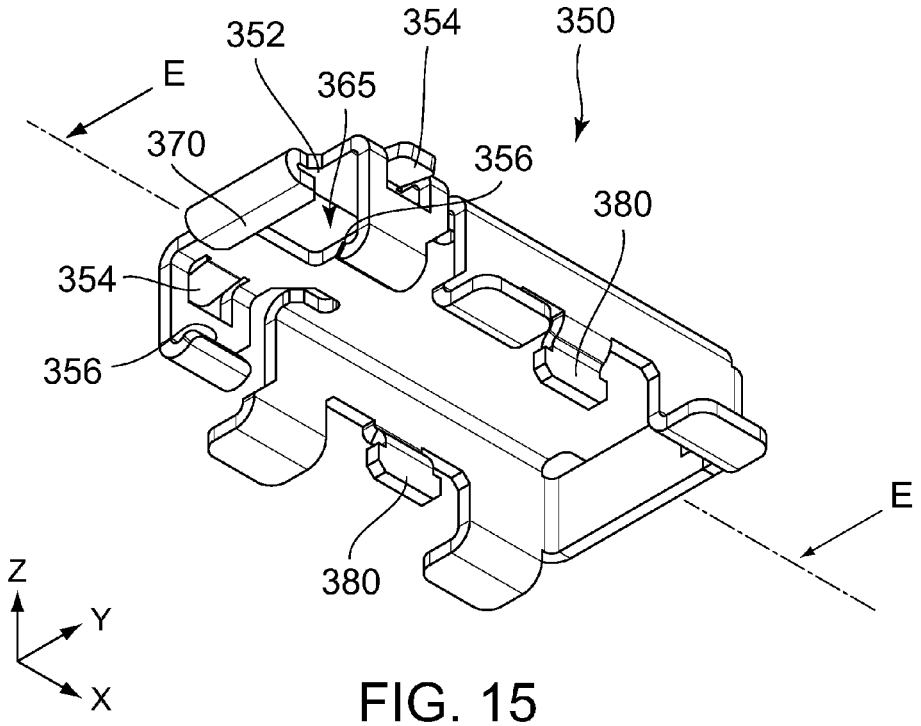
FIG. 15 is a perspective view showing a mating shell which is included in the mating connector of FIG. 10.
Figure 16:
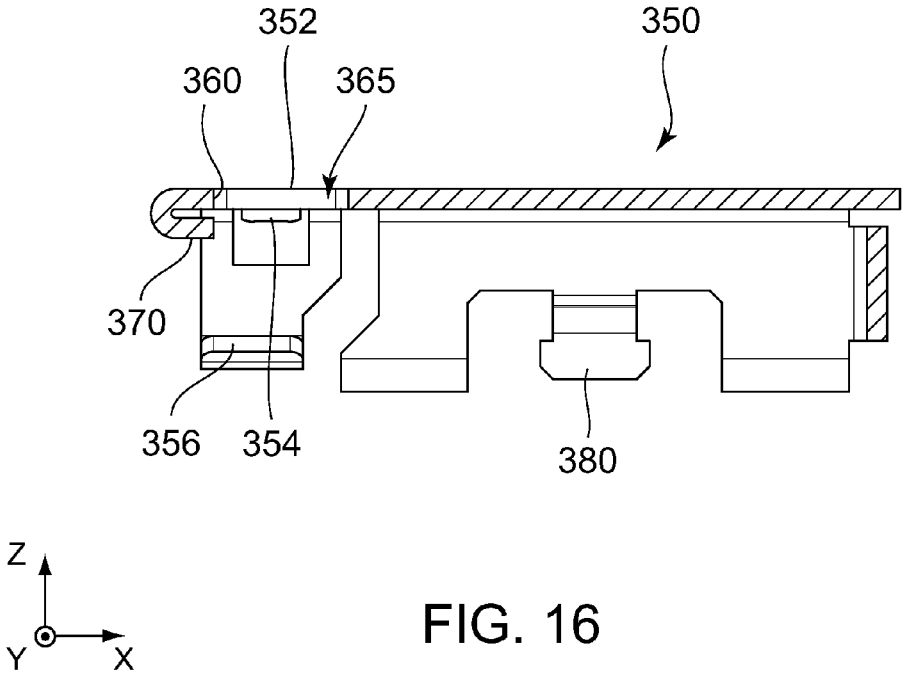
FIG. 16 is a cross-sectional view showing the mating shell of FIG. 15, taken along line E-E.

As shown in FIGS. 9, 15 and 16, the mating shell 350 is provided with a spring portion 352 and two press-fit portions 380. The spring portion 352 is resiliently deformable. As understood from FIGS. 9 and 10, when the press-fit portions 380 are press-fitted into the shell holding portions 326, respectively, the spring portion 352 is positioned above the upper recess 330. Accordingly, the spring portion 352 is resiliently deformable without being regulated by the mating housing 320. As shown in FIGS. 9, 15 and 16, the spring portion 352 is formed with an opening 365. A negative X-side edge of the opening 365 functions as a mating lock portion 360. An end, or a negative X-side end, of the spring portion 352 is folded back to form a shell contact portion 370. Thus, the mating shell 350 is provided with the mating lock portion 360 and the shell contact portion 370. Specifically, the shell contact portion 370 of the present embodiment is positioned toward a negative X-side of the mating lock portion 360. Tabs 354 and second regulating portions 356 are provided at opposite ends of the spring portion 352 in the lateral direction, respectively. Each of the tabs 354 projects outward in the lateral direction. Each of the second regulating portions 356 has a J-shaped cross section in the plane, or the YZ-plane, perpendicular to the front-rear direction. As expected from FIG. 9, when the tabs 354 are moved upward by using a jig, the spring portion 352 can be forcibly bent. If the spring portion 352 is excessively bent, the spring portion 352 may be excessively deformed. In the present embodiment, when the spring portion 352 is about to be excessively bent, the second regulating portions 356 abut the first regulating portions 340, respectively. Accordingly, the spring portion 352 is prevented from being excessively deformed.

As understood from FIGS. 1 to 3, 6, 9 and 10, when the first member 110 of the connector 100 is inserted into the mating connector 300 along the front-rear direction so that the connector 100 and the mating connector 300 are connected with each other, the first contact portion 112 of the first member 110 is brought into contact with the mating contact 310 while the shell contact portion 370 is brought into contact with the second contact portion 156. In particular, in the present embodiment, under the connection state where the connector 100 and the mating connector 300 are connected with each other, the second contact portion 156 is brought into contact with the shell contact portion 370 from an inside of the mating connector 300 as shown in FIG. 2. At that time, the lock portion 140 is positioned in the opening 365 while locking the mating lock portion 360 so that the connection state of the connector 100 and the mating connector 300 is maintained. In detail, under the connection state where the connector 100 and the mating connector 300 are connected with each other, the spring portion 352 (see FIG. 1) presses the shell contact portion 370 against the second contact portion 156 so that the second contact portion 156 is sandwiched between the shell contact portion 370 and the insulator 520. At that time, the first member 110 and the second member 120 are maintained in a state where the first member 110 and the second member 120 are electrically separated from each other as apparent from FIGS. 1 and 2. Accordingly, in the connector 100 of the present embodiment, the first member 110 and the second member 120 can be prevented from being short-circuited with each other without being provided with a housing. Thus, the height of the connector 100 can be lowered so that the connector assembly 10 can be reduced in height.

Under the connection state where the connector 100 and the mating connector 300 are connected with each other as shown in FIG. 1, when the tabs 354 are moved upward to be pulled or pushed up by using the jig (not shown) so that the spring portion 352 is resiliently deformed, a lock of the lock portion 140 against the mating lock portion 360 can be released as understood from FIG. 2. Accordingly, the connector 100 can be released from the mating connector 300. Thus, the connector assembly 10 according to the present embodiment has a structure in which the connector 100 is repeatedly insertable into the mating connector 300.

In the aforementioned embodiment, the second contact portion 156 is brought into contact with the shell contact portion 370 from the inside of the mating connector 300. The second contact portion 156 may however be brought into contact with the shell contact portion 370 from an outside of the mating connector 300. In that case, the connector 100 has an increased height. In a case where the connector 100 is provided with the first member 110 and the second member 120 so that the first member 110 and the second member 120 do not overlap each other in the front-rear direction similar to the present embodiment, it is preferable that the second contact portion 156 is brought into contact with the shell contact portion 370 from the inside of the mating connector 300.

Second Embodiment

Figure 17:
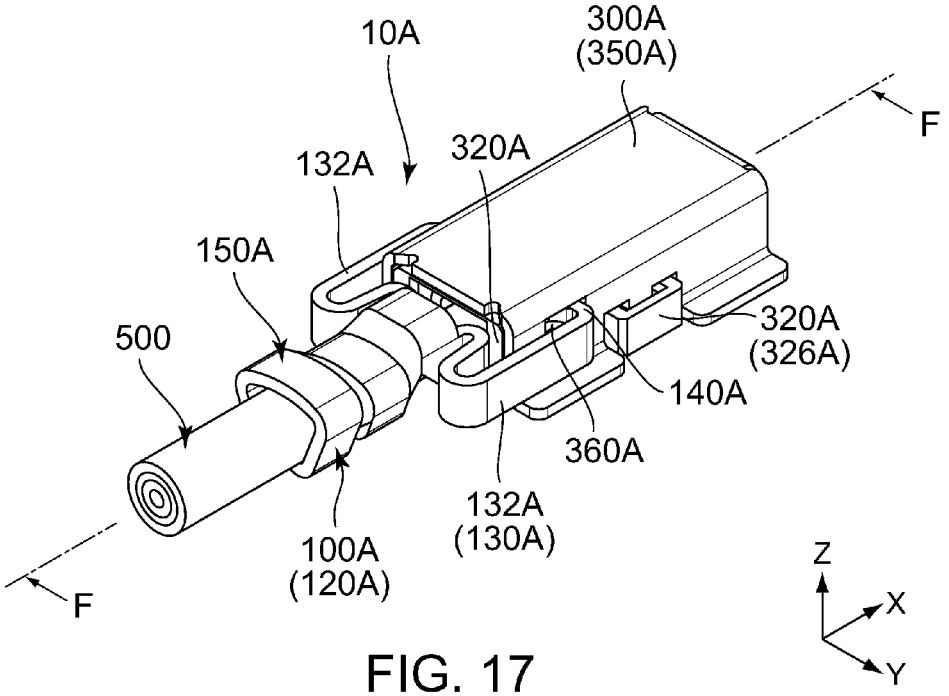
FIG. 17 is a perspective view showing a connector assembly which comprise a connector and a mating connector according to a second embodiment of the present invention.
Figure 18:
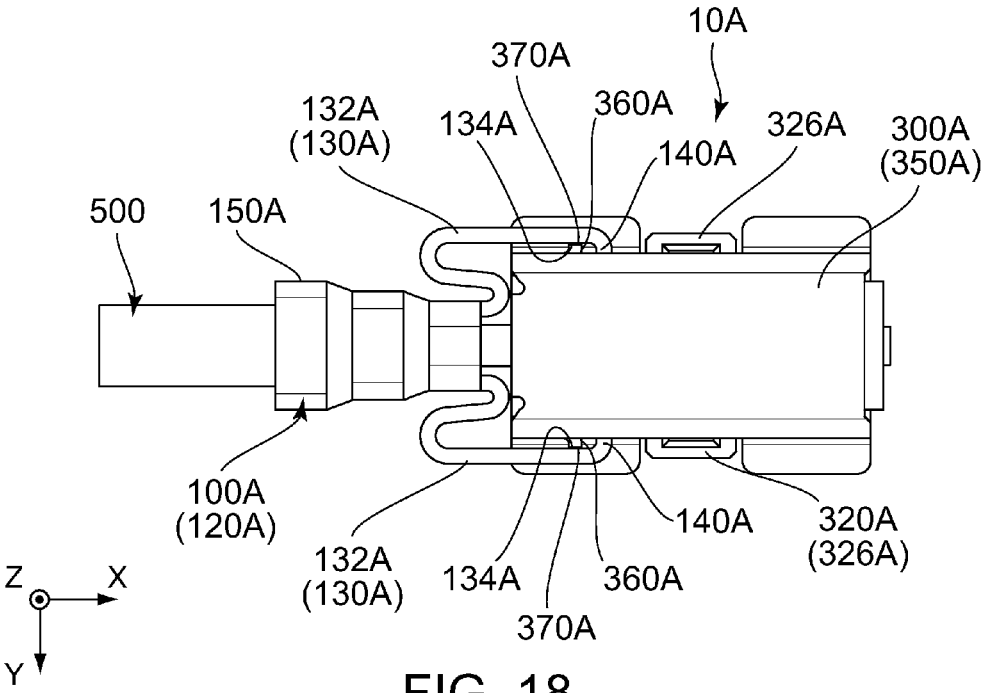
FIG. 18 is a top view showing the connector assembly of FIG. 17.
Figure 19:
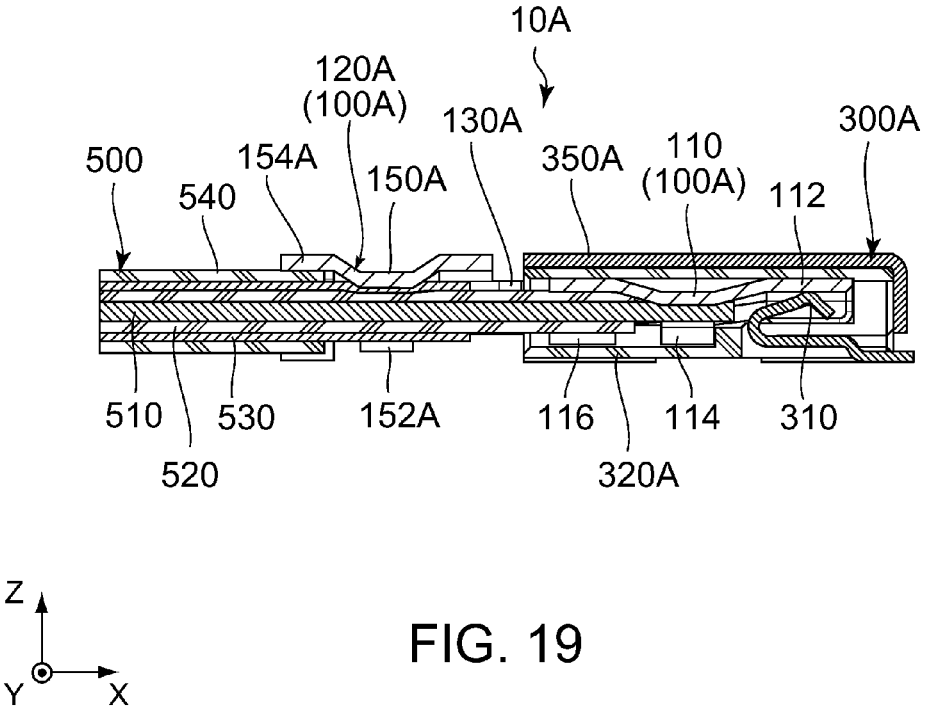
FIG. 19 is a cross-sectional view showing the connector assembly of FIG. 17, taken along line F-F.

With reference to FIGS. 17 to 19, a connector assembly 10A according to a second embodiment of the present invention comprises a connector 100A and a mating connector 300A. The connector 100A is attached to the cable 500. The mating connector 300A is to be fixed on an object (not shown) such as a circuit board. The connector 100A and the mating connector 300A are connected with each other in a connection direction. The cable 500 which is attached to the connector 100A extends in an extending direction. Similar to the aforementioned first embodiment, each of the connection direction and the extending direction of the present embodiment is the front-rear direction, or the X-direction. In other words, the connection direction and the extending direction are same as each other. In addition, the cable 500 of the present embodiment is same as that of the aforementioned first embodiment. Accordingly, detail description about the cable 500 of the present embodiment is omitted.

Figure 20:
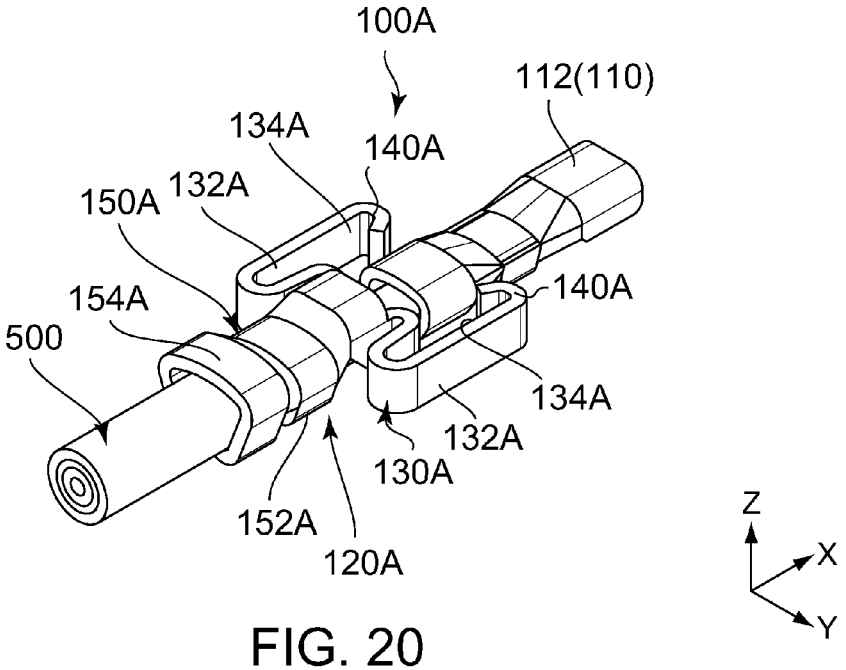
FIG. 20 is a perspective view showing the connector which is included in the connector assembly of FIG. 17.
Figure 21:
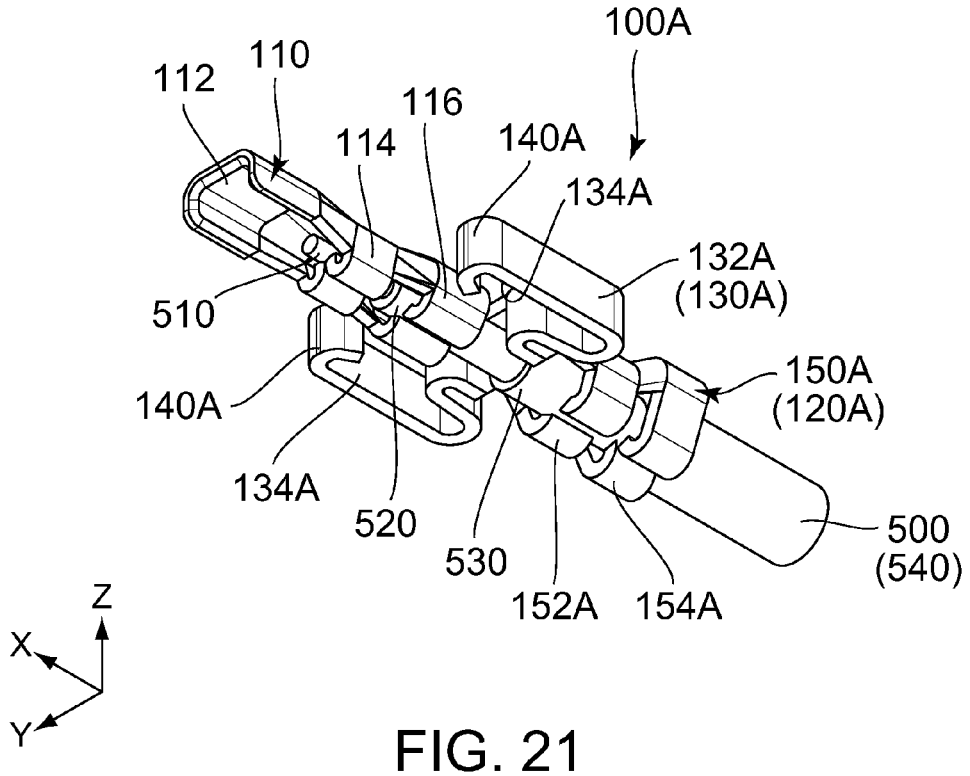
FIG. 21 is another perspective view showing the connector of FIG. 20.
Figure 22:
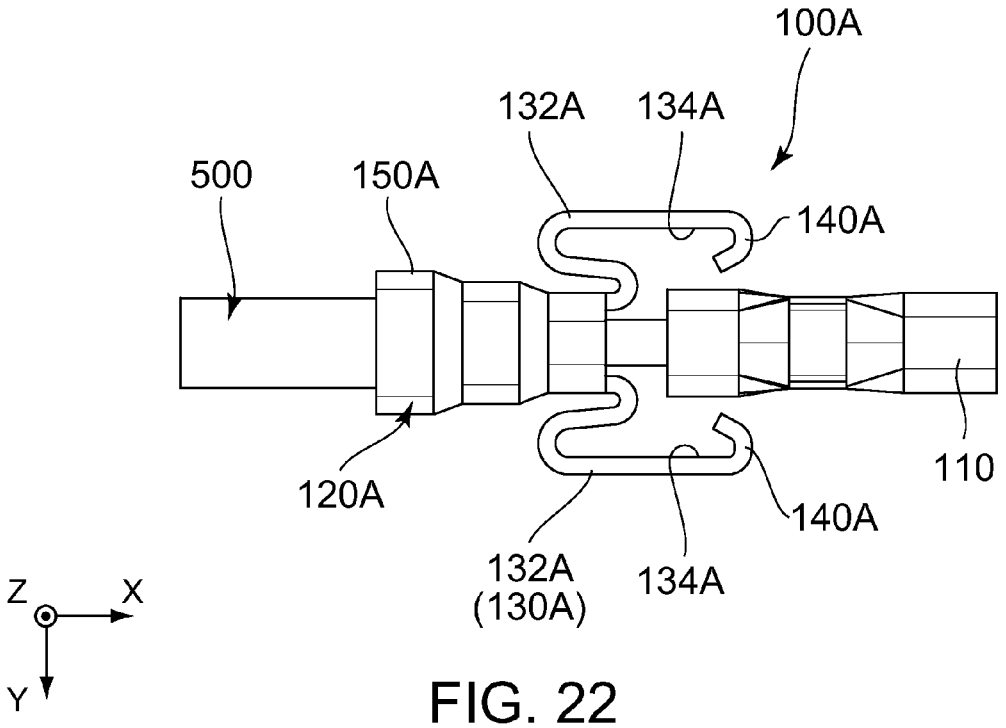
FIG. 22 is a top view showing the connector of FIG. 20.

As shown in FIGS. 20 to 22, the connector 100A comprises a first member 110 and a second member 120A. The first member 110 is made of conductor. The second member 120A is made of conductor. The first member 110 of the present embodiment is same as that of the aforementioned first embodiment. Accordingly, detail description about the first member 110 of the present embodiment is omitted. Each of the first member 110 and the second member 120A may not be made of conductor. For example, each of the first member 110 and the second member 120A may be formed of non-conductive material plated with conductor.

Similar to the connector 100 of the first embodiment, the connector 100A according to the present embodiment does not comprise a housing which holds the first member 110. Accordingly, the first member 110 and the second member 120A are separated from each other and are independently attached to the cable 500.

As shown in FIGS. 20 to 22, the second member 120A is positioned rearward of the first member 110 in the front-rear direction. The second member 120A has a front portion 130A and a rear portion 150A. The rear portion 150A is positioned rearward of the front portion 130A.

As understood from FIGS. 20 to 22 and FIGS. 3 to 5, the rear portion 150A of the present embodiment has a structure essentially same as that of the rear portion 150 of the aforementioned first embodiment. Specifically, the rear portion 150A has a second connection portion 152A and an outer cover holding portion 154A. The second connection portion 152A is connected to the shield 530. The outer cover holding portion 154A holds the outer cover 540. As understood from FIG. 21, the second connection portion 152A is crimped on the shield 530 to be connected thereto, and the outer cover holding portion 154A is crimped on the outer cover 540 to hold it. Although the second contact portion 156 of the first embodiment is a part of the rear portion 150, second contact portions 134A of the present embodiment are not provided at the rear portion 150A as described later.

As shown in FIGS. 20 to 22, the front portion 130A is provided with spring portions 132A and lock portions 140A. Each of the spring portions 132A is resiliently deformable. The lock portions 140A are supported by the spring portions 132A, respectively. As described later, under a connection state where the connector 100A and the mating connector 300A are connected with each other, the lock portions 140A lock parts of the mating connector 300A, respectively, so that the connector 100A and the mating connector 300A are maintained in the connection state. As described later, parts of the spring portions 132A function as the second contact portions 134A which are brought into contact with parts of the mating connector 300A, respectively. The lock portions 140A are positioned frontward of the second contact portions 134A in the front-rear direction, respectively. In the present embodiment, each of the lock portions 140A constitutes an end, or a positive X-side end, of the second member 120A. In addition, as shown in FIGS. 20 and 21, a whole of the front portion 130A of the present embodiment is positioned frontward of the second connection portion 152A in the front-rear direction. Accordingly, when the second connection portion 152A is crimped on the shield 530, the front portion 130A provides no obstacle to the crimping operation of the second connection portion 152A. Similarly, when the outer cover holding portion 154A is crimped on the outer cover 540, the front portion 130A provides no obstacle to the crimping operation of the outer cover holding portion 154A.

As understood from FIG. 19, in the present embodiment, an upper end of the outer cover holding portion 154A is positioned at an uppermost part of the second member 120A in the up-down direction, or the Z-direction, while a whole of the front portion 130A is positioned below, or toward a negative Z-side of, the outer cover holding portion 154A in the up-down direction.

As understood from FIGS. 20 to 22, the second member 120A of the present embodiment has only the front portion 130A and the rear portion 150A. Specifically, similar to the second member 120 of the first embodiment, the second member 120A of the present embodiment does not have a function similar to that of a shell which surrounds the first member 110 in the plane, or the YZ-plane, perpendicular to the front-rear direction. In addition, as understood from FIG. 22, the first member 110 does not overlap the second member 120A so that the first member 110 is visible when the first member 110 is seen along the up-down direction under a state where the first member 110 and the second member 120A are attached to the cable 500.

Figure 23:
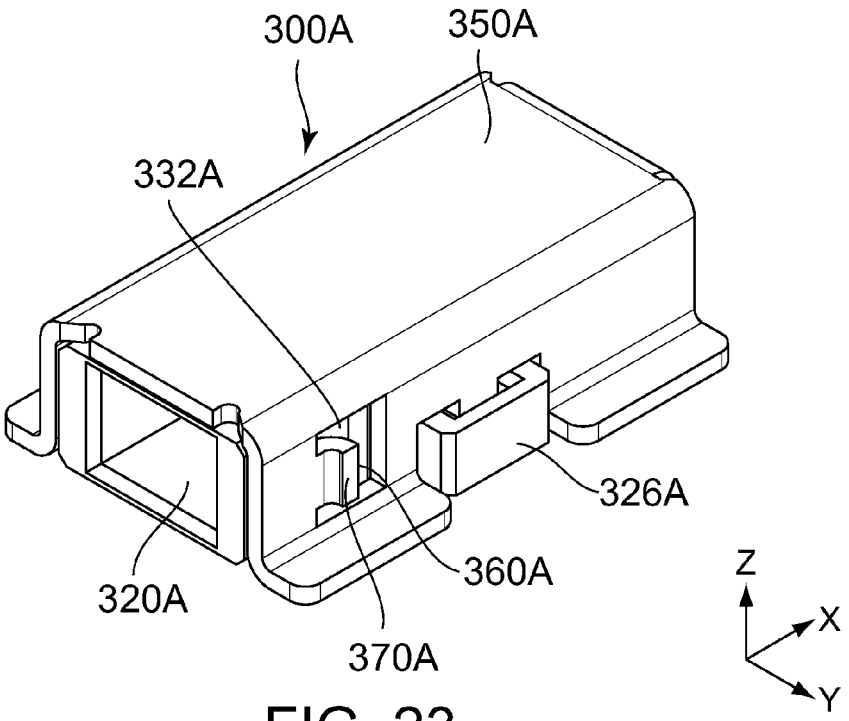
FIG. 23 is a perspective view showing the mating connector which is included in the connector assembly of FIG. 17.
Figure 24:
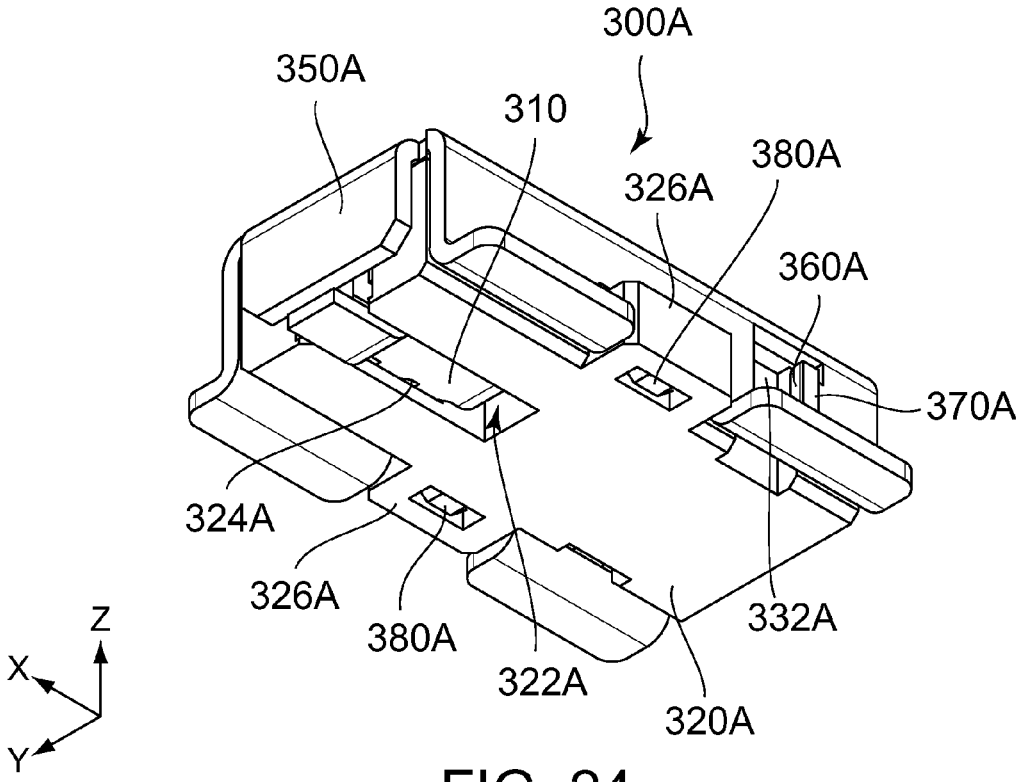
FIG. 24 is another perspective view showing the mating connector of FIG. 23.

As understood from FIGS. 23 and 24, the mating connector 300A comprises a mating contact 310, a mating housing 320A and a mating shell 350A. The mating contact 310 is made of conductor. The mating housing 320A is made of insulator. The mating shell 350A is made of metal. In essential structure and function, the mating contact 310 of the present embodiment is similar to the mating contact 310 of the aforementioned first embodiment. Accordingly, detail description about the mating contact 310 of the present embodiment is omitted.

Figure 25:
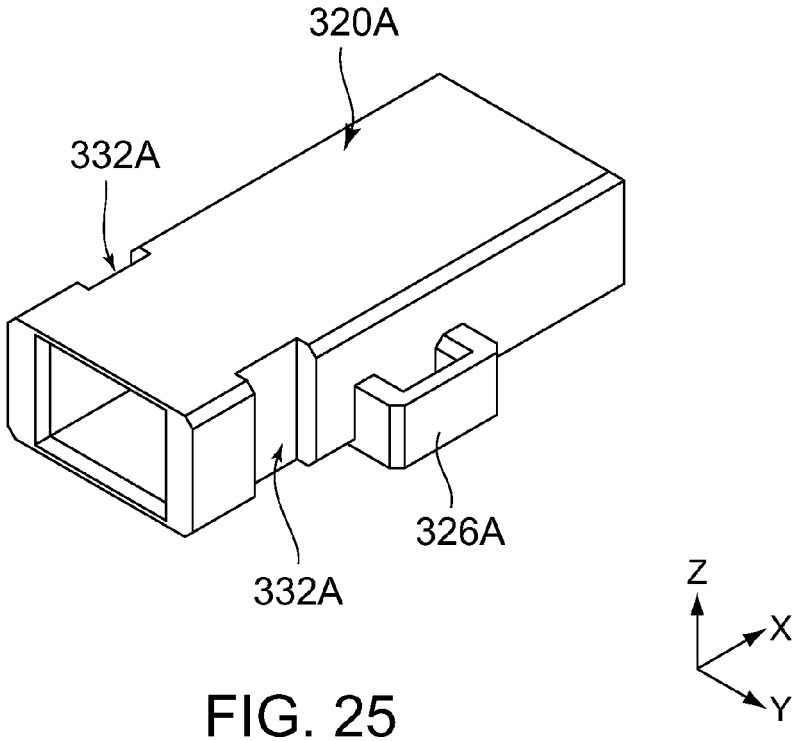
FIG. 25 is a perspective view showing a mating housing which is included in the mating connector FIG. 23.
Figure 26:
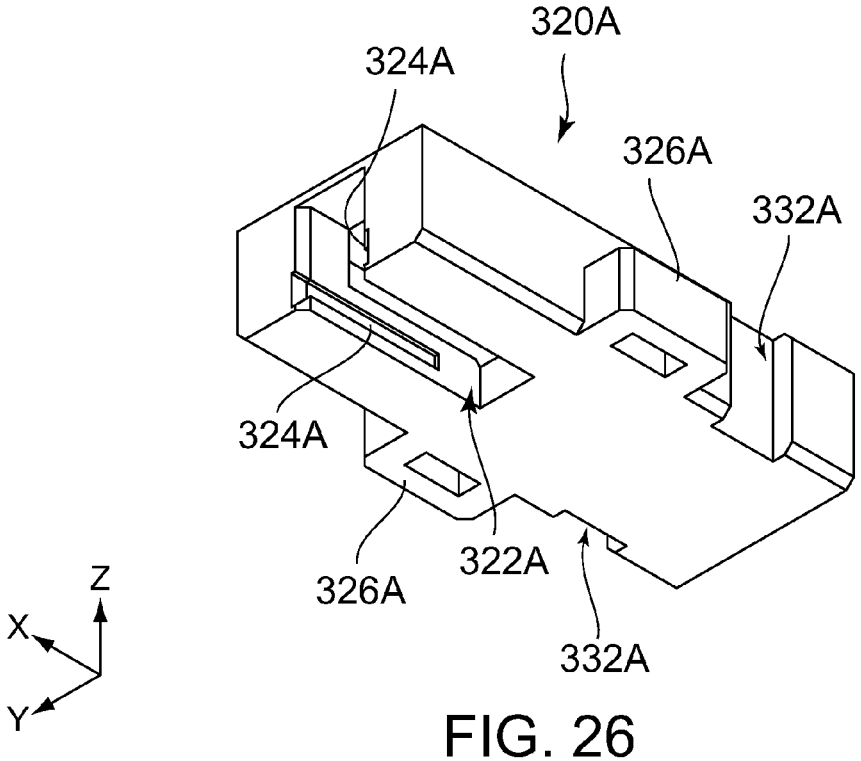
FIG. 26 is a perspective view showing the mating housing which is included in the mating connector FIG. 24.

As shown in FIGS. 25 and 26, the mating housing 320A has a substantially rectangular tube-like shape. As shown in FIGS. 24 and 26, the mating housing 320A is provided with a lower recess 322A. The lower recess 322A has two inner walls which face each other in the lateral direction. When the press-fit portion 312 (see FIG. 11) of the mating contact 310 is press-fitted into the lower recess 322A, the two inner walls function as contact holding portions 324A, respectively, which hold the mating contact 310. As shown in FIGS. 25 and 26, the mating housing 320A is further formed with two shell holding portions 326A and two end part accommodation portions 332A. Each of the shell holding portions 326A projects outward in the lateral direction. As described later, the shell holding portions 326A hold parts of the mating shell 350A, respectively. Each of the end part accommodation portions 332A is recessed inward in the lateral direction. Although each of the end part accommodation portions 332A reaches both an upper surface, or a positive Z-side surface, and a lower surface, or a negative Z-side surface, of the mating housing 320A, the present invention is not limited thereto. Each of the end part accommodation portions 332A may not reach both the upper surface and the lower surface. However, considering miniaturization of the whole connector assembly 10A, it is easier to manufacture the mating housing 320A having the end part accommodation portions 332A each of which reaches both the upper surface, or the positive Z-side surface, and the lower surface, or the negative Z-side surface, of the mating housing 320A similar to the present embodiment.

Figure 27:
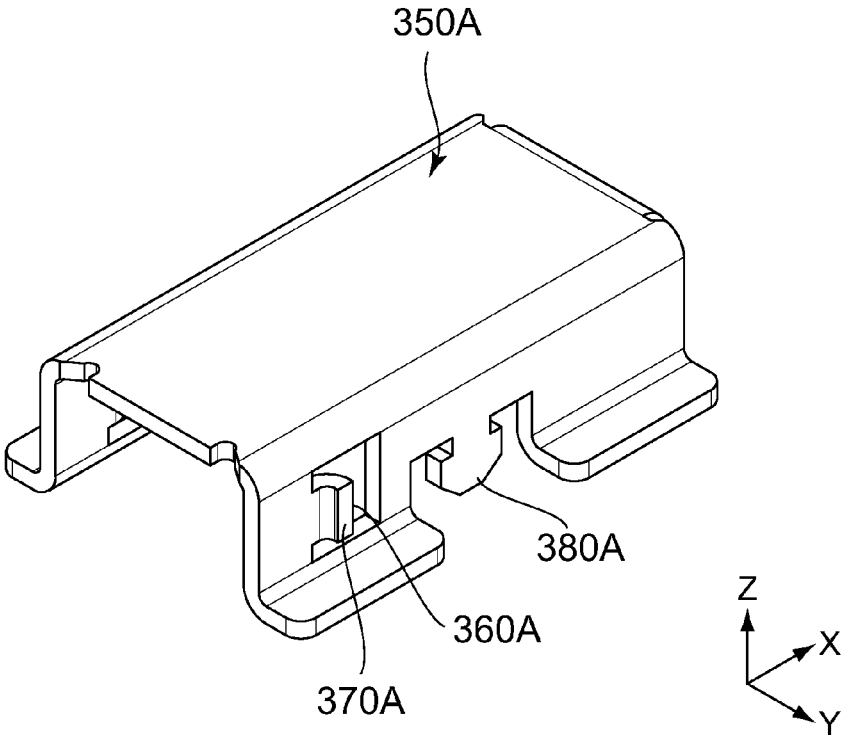
FIG. 27 is a perspective view showing a mating shell which is included in the mating connector FIG. 23.
Figure 28:
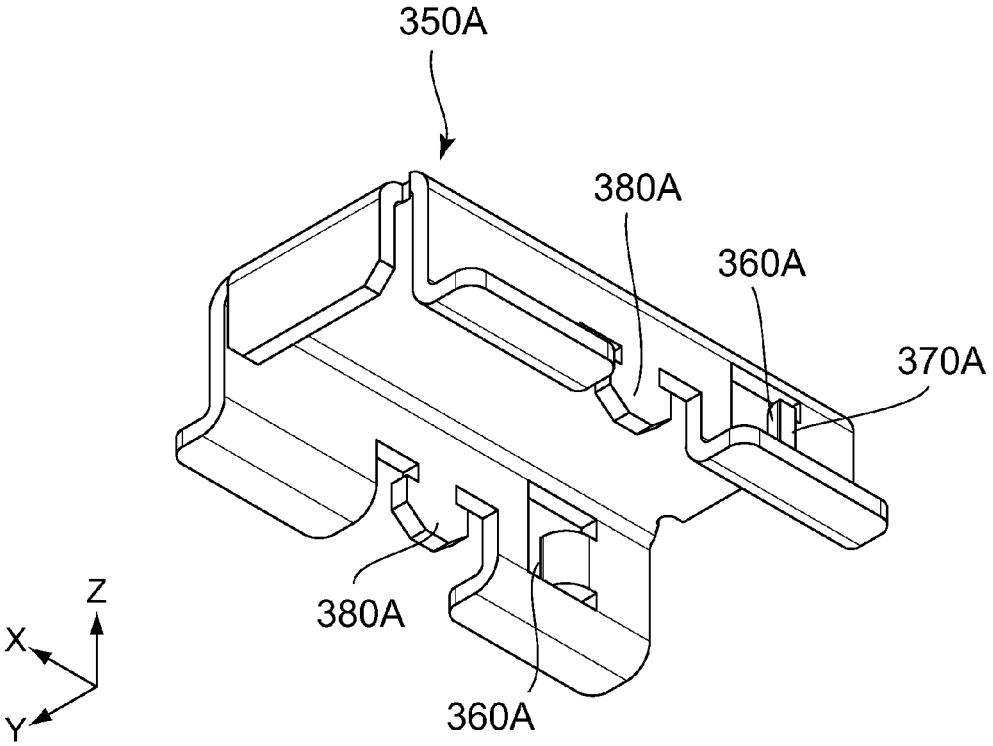
FIG. 28 is a perspective view showing the mating shell which is included in the mating connector FIG. 24.
Figure 29:
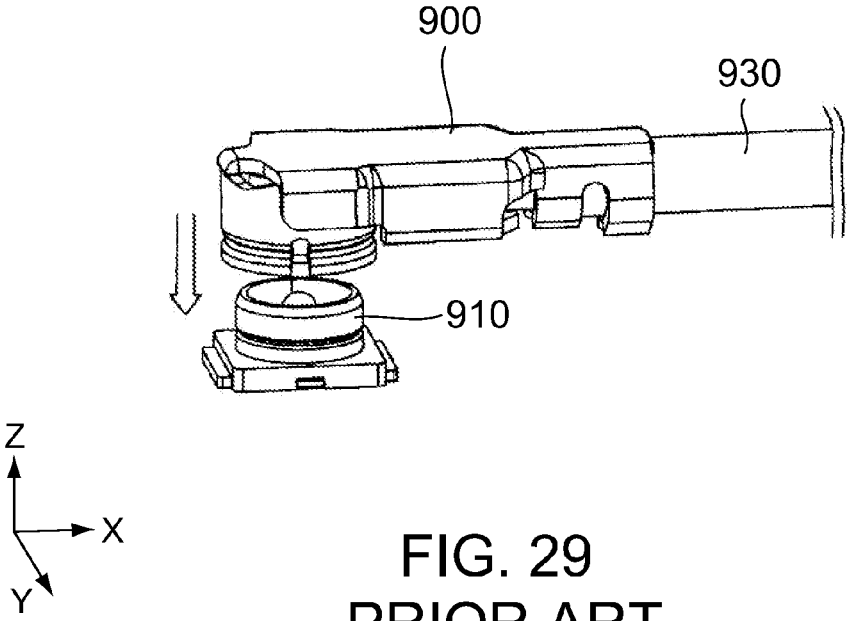
FIG. 29 PRIOR ART
FIG. 29 is a view showing a prior art connector assembly described in Patent Document 1.
Figure 30:
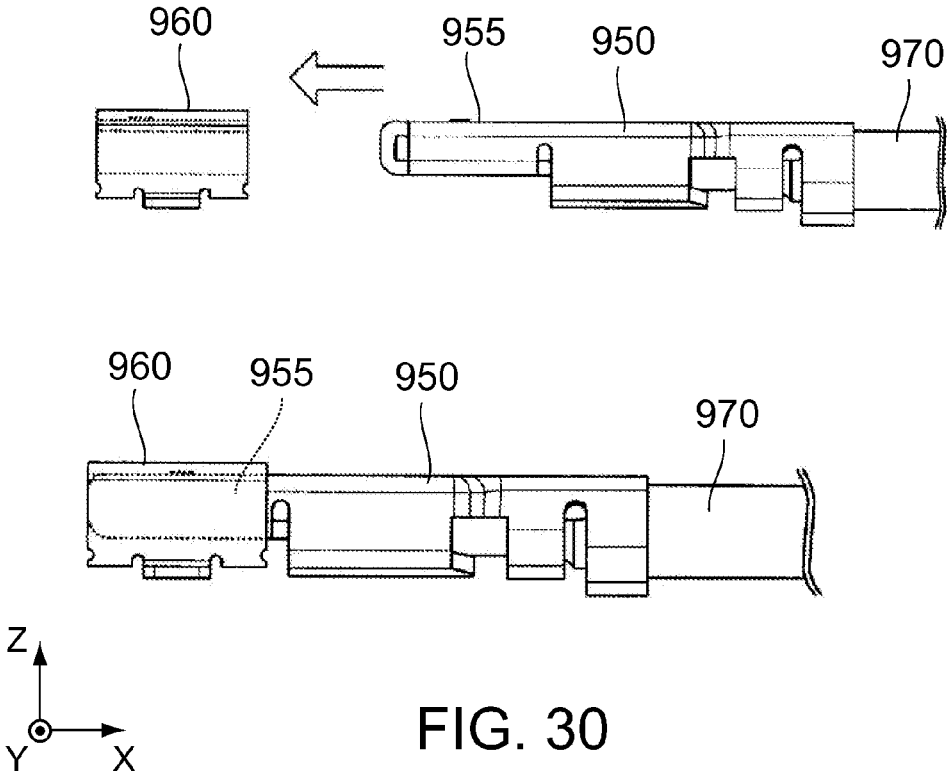
FIG. 30 PRIOR ART
FIG. 30 is a view showing a connector assembly of Patent Document 1.

As shown in FIGS. 27 and 28, the mating shell 350A is provided with two press-fit portions 380A and two mating lock portions 360A. The press-fit portions 380A correspond to the shell holding portions 326A, respectively. The mating lock portions 360A correspond to the end part accommodation portions 332A, respectively. As understood from FIGS. 24 and 28, when each of the press-fit portions 380A is press-fitted into the corresponding shell holding portion 326A, each of the mating lock portions 360A is positioned outward of the corresponding end part accommodation portion 332A in the lateral direction. Specifically, cavities are formed inside the mating lock portions 360A by the end part accommodation portions 332A, respectively, in the lateral direction. As understood from FIGS. 17, 18, 23 and 24, under the connection state where the connector 100A and the mating connector 300A are connected with each other, ends of the lock portions 140A are accommodated into the cavities of the end part accommodation portions 332A, respectively. When the connector 100A is to be released from the mating connector 300A in this state, the lock portions 140A abut against the mating lock portions 360A, respectively. Specifically, each of the lock portions 140A locks the corresponding mating lock portion 360A so that the connector 100A and the mating connector 300A are maintained in the connection state of the connector 100A and the mating connector 300A. The second contact portions 134A are parts of the spring portions 132A, respectively. The shell contact portions 370A are positioned at ends of the mating lock portions 360A, respectively, in the lateral direction. The second contact portions 134A correspond to the shell contact portions 370A, respectively. In addition, as shown in FIG. 18, when each of the lock portions 140A locks the corresponding mating lock portion 360A, each of the second contact portions 134A is brought into contact with the corresponding shell contact portion 370A. Thus, the second member 120A and the mating shell 350A are electrically connected with each other. At that time, each of the second contact portions 134A is brought into contact with the corresponding shell contact portion 370A from an outside of the corresponding shell contact portion 370A in the lateral direction as understood from shapes and arrangements of the spring portions 132A. Specifically, as shown in FIGS. 18 and 19, in the present embodiment, only the first member 110 of the connector 100A is accommodated inside the mating connector 300A and the second member 120A is not accommodated thereinside. Accordingly, the first member 110 and the second member 120A are never short-circuited with each other.

As understood from FIGS. 17 to 23, when the first member 110 of the connector 100A is inserted into the mating connector 300A along the front-rear direction so that the connector 100A and the mating connector 300A are connected with each other, the first contact portion 112 of the first member 110 is brought into contact with the mating contact 310. In the aforementioned connection process, the spring portions 132A are resiliently deformed. At that time, the lock portions 140A are moved outward in the lateral direction and then moved inward in the lateral direction. Accordingly, the connector assembly 10A is under a state shown in FIG. 18 and each of the second contact portions 134A is brought into contact with the corresponding shell contact portion 370A. At that time, each of the lock portions 140A locks the corresponding mating lock portion 360A so that the connector 100A and the mating connector 300A are maintained in the connection state of the connector 100A and the mating connector 300A. At that time, only the first member 110 is positioned at the inside of the mating connector 300A as described above. Accordingly, the first member 110 and the second member 120A are maintained in a state where the first member 110 and the second member 120A are electrically separated from each other. Thus, in the connector 100A of the present embodiment, the first member 110 and the second member 120A can be prevented from being short-circuited with each other without being provided with a housing. Accordingly, a height of the connector 100A can be lowered so that the connector assembly 10A can be reduced in height.

As shown in FIGS. 17 and 18, under the connection sate where the connector 100A and the mating connector 300A are connected with each other, when the spring portions 132A are resiliently deformed so as to open outward in the lateral direction by a jig (not shown), locks of the lock portions 140A against the mating lock portions 360A can be released. Accordingly, the connector 100A can be released from the mating connector 300A. Thus, the connector assembly 10A according to the present embodiment has a structure in which the connector 100A is repeatedly insertable into the mating connector 300A.

In the aforementioned embodiment, the shell contact portions 370A are formed as edges of ends of the mating lock portions 360A, respectively. However, the present invention is not limited thereto. For example, the shell contact portion 370A may be formed as a bent portion which is formed by folding or bending an end of the mating lock portion 360A. However, in a case where the mating lock portion 360A is formed by cutting and bending out a part of a side wall of the mating shell 350A similar to the present embodiment, it is necessary to cut and bend out a large part of the mating shell 350A in order to fold or bent the end of the mating lock portion 360A. In addition, the cutting and bending out of the large part of the mating shell 350A might cause degradation of a main function thereof. Accordingly, it is preferable that the shell contact portions 370A have shapes similar to the present embodiment.

Although each of the mating lock portions 360A of the present embodiment is formed by cutting and bending out the part of the side wall of the mating shell 350A as described above, the present invention is not limited thereto. For example, the mating lock portion 360A may be formed by expanding an end, or a negative X-side end, of the mating shell 350A to fold back the expanded portion of the end. In that case, the main function of the mating shell 350A is not degraded while the shell contact portion 370A can be formed by using a part other than the edge of the end of the mating lock portion 360A.

The present application is based on a Japanese patent application of JP2014-152134 filed before the Japan Patent Office on Jul. 25, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction and attachable to a cable which has a center conductor, an insulator, a shield, and an outer cover, the outer cover covering the shield, the insulator insulating the center conductor and the shield from each other, the mating connector comprising a mating contact and a mating shell, and the mating shell being provided with a mating lock portion and a shell contact portion, the connector comprising:

a first member; and a second member which is formed separately from the first member;

wherein:

the first member is positioned frontward of the second member in the front-rear direction;

the first member has a first connection portion and a first contact portion;

the first connection portion is configured to be connected to the center conductor;

when the connector and the mating connector are connected with each other, the first contact portion is brought into contact with the mating contact;

the second member has a front portion and a rear portion which is positioned rearward of the front portion in the front-rear direction;

the rear portion is provided with a second connection portion which is configured to be connected to the shield;

the front portion is provided with a lock portion;

one of the rear portion and the front portion is provided with a second contact portion; and under a state where the connector and the mating connector are connected with each other, the lock portion locks the mating lock portion while the second contact portion is brought into contact with the shell contact portion, so that the first member and the second member are maintained in a state where the first member and the second member are electrically separated from each other.

2. The connector as recited in claim 1, wherein the second member has only the front portion and the rear portion.

3. The connector as recited in claim 1, wherein:

the second connection portion is to be crimped on the shield to be connected to the shield; and a whole of the front portion is positioned frontward of the second connection portion in the front-rear direction.

4. The connector as recited in claim 1, wherein the first member does not overlap the second member so that the first member is visible when the first member is seen along an up-down direction perpendicular to the front-rear direction under a state where the first member and the second member are attached to the cable.

5. The connector as recited in claim 1, wherein:

the rear portion has an outer cover holding portion which is configured to hold the outer cover;

the outer cover holding portion is positioned at an uppermost part of the second member in an up-down direction perpendicular to the front-rear direction; and the front portion is positioned below the outer cover holding portion in the up-down direction.

6. The connector as recited in claim 1, wherein the lock portion is positioned frontward of the second contact portion in the front-rear direction.

7. The connector as recited in claim 1, further comprising an insulator member, the insulator member being positioned between the first member and the second member in the front-rear direction while being positioned so as to surround the cable.

8. The connector as recited in claim 7, wherein:

the insulator member has an inner periphery;

a first area is defined by the inner periphery in a plane perpendicular to the front-rear direction;

the first member has a rear end configured to be attached to the cable;

a second area is a total area of a cross-section of the rear end and a cross-section of the cable in a plane perpendicular to the front-rear direction; and the first area is smaller than the second area.

9. The connector as recited in claim 7, wherein the insulator member is formed by separating a part of an outer cover which covers the shield.

10. The connector as recited in claim 1, wherein the first member is positioned apart from the second member in the front-rear direction.

11. The connector as recited in claim 10, wherein the second contact portion is brought into contact with the shell contact portion from an inside of the mating connector under a connection state where the connector and the mating connector are connected with each other.

12. A connector assembly comprising the connector as recited in claim 10 and the mating connector, wherein:

the mating shell has a spring portion;

the mating lock portion and the shell contact portion are provided at the spring portion; and under a state where the connector and the mating connector are connected with each other, the spring portion presses the shell contact portion against the second contact portion so that the second contact portion is sandwiched between the shell contact portion and the insulator.

13. The connector assembly as recited in claim 12, wherein:

the mating connector comprises a mating housing which holds the mating contact;

the mating housing is provided with a first regulating portion;

the mating shell is provided with a second regulating portion; and the second regulating portion abuts the first regulating portion to regulate a resilient deformation of the spring portion when the spring portion is resiliently deformed.

14. The connector assembly as recited in claim 12, wherein:

the spring portion is provided with a tab which projects outward; and a lock of the lock portion against the mating lock portion is released when the tab is operated by a jig so that the spring portion is resiliently deformed.

15. The connector as recited in claim 1, wherein:

the front portion has a spring portion which is resiliently deformable;

the lock portion is supported by the spring portion; and the spring portion is positioned outward of the mating shell under a connection state where the connector and the mating connector are connected with each other.

16. The connector as recited in claim 15, wherein:

the spring portion is positioned outward of the rear portion in a lateral direction perpendicular to the front-rear direction; and the spring portion extends frontward of the rear portion in the front-rear direction.

17. A connector assembly comprising the connector as recited in claim 15 and the mating connector, wherein:

the shell contact portion is positioned rearward of the mating lock portion and projects outward; and the shell contact portion is brought into contact with the spring portion of the front portion from an inside of the spring portion.

* * * * *